US006152800A

United States Patent [19]

Higuchi

[11] Patent Number: 6,152,800

[45] Date of Patent: Nov. 28, 2000

[54] ORNAMENTAL TRACK TOY

[75] Inventor: Samuel Higuchi, Amherst, Va.

[73] Assignee: Wonders, Inc., Amherst, Va.

[21] Appl. No.: 09/299,622

[22] Filed: Apr. 27, 1999

[51] Int. Cl.[7] ..... A63H 19/24

[52] U.S. Cl. ..... 446/444; 40/414; 40/415; 238/10 F

[58] Field of Search ..... 446/236, 237, 446/433, 444, 467; 40/414, 415; 238/10 E, 10 F

[56] References Cited

U.S. PATENT DOCUMENTS

| | | | |
|---|---|---|---|
| D. 257,734 | 12/1980 | Rosenberg | D21/541 |
| 1,842,021 | 1/1932 | Hanley | 105/49 |
| 2,956,357 | 10/1960 | Rakes | 40/457 |
| 4,231,294 | 11/1980 | Arzoumanian | 238/10 E X |
| 5,211,366 | 5/1993 | Cummings | 248/237 |
| 5,279,871 | 1/1994 | Segan et al. | 428/18 |
| 5,450,682 | 9/1995 | Franco et al. | 40/415 |
| 5,588,164 | 12/1996 | Proulx | 446/444 X |

*Primary Examiner*—John A. Ricci
*Attorney, Agent, or Firm*—Millen, White, Zelano & Branigan, P.C.

[57] ABSTRACT

An ornamental track toy includes a loop track assembly, a motor, an elongated coupling and an ornament. The track assembly includes a hollow base having a flat surface, a slot in the flat surface and the elongated coupling slidably mounted in a hollow channel in the base. The motor includes a gear and a pinch roller for moving the elongated coupling in a loop path around the track assembly. The elongated coupling includes a link that is connected to the ornament so that the ornament is pulled around the track assembly as the elongated coupling is moved around the loop path of the track assembly.

15 Claims, 3 Drawing Sheets

ORNAMENTAL TRACK TOY

The present invention relates to a toy track along which an ornament moves. In a preferred embodiment, the toy track is a train track about which a toy train moves wherein the track may be mounted onto a Christmas tree.

BACKGROUND OF THE INVENTION

Toy tracks which simulate railroads or automotive roads are well known. Further, various types of mechanisms for moving ornaments, such as Christmas ornaments, along a path are also known. It is common for retail stores such as toy stores and department stores to set up elaborate decorations at Christmas including trains, sleighs and other motion characters.

Toy trains are particularly popular at Christmas time when a track may be set up around the base of a Christmas tree to give a decorative effect to the tree. These toy trains are typically mounted and supported on the floor around the trunk of the tree. Further, in some prior art toys, the track can be mounted to the Christmas tree so that the train is supported in an elevated position above the floor.

Some of the difficulties associated with toy trains at Christmas time include setting up the train on the floor where children and pets may knock the train off the tracks or become shocked, if the train is powered by electric tracks. Prior art mechanisms that have a track mounted further up the tree also have problems with becoming uneven and allowing the train to tip over. Also, the moving train becomes a desirable object for a child or pet to reach up to and pull on, particularly if the train is exposed and is even close to within reach of the child or pet. Finally, most toy ornaments, including toy trains, require extra electrical outlets to power the system. This may require extra extension cords and be inconvenient to a user. Also open tracks alone present a fire hazard because of the exposed electrical circuit.

SUMMARY OF THE INVENTION

Accordingly, it is an object of the present invention to provide a track toy that overcomes the foregoing drawbacks. The track toy would be mounted or placed around a Christmas tree and have a train ornament that travels around the circuit of the track toy.

In a preferred embodiment, the track toy comprises a loop track assembly, a motor, an elongated coupling and an ornament. The track assembly comprises a hollow base having a flat surface and a slot in the flat surface. The elongated coupling is slidably mounted in a hollow channel in the base. The motor comprises a gear and an engaging means for moving the elongated coupling in a loop path around the track assembly. The elongated coupling is a continuous member and comprises a link, and the link is received into a connector in the ornament whereby the ornament is pulled around the track assembly as the elongated coupling is moved around the loop path of the track assembly. Additional features include a track assembly having a plurality of slots. The invention also includes a track assembly having a transparent enclosure that, combined with the flat surface, forms a tube along the loop path.

DETAILED DESCRIPTION OF A PREFERRED EMBODIMENT OF THE INVENTION

Figure 1:
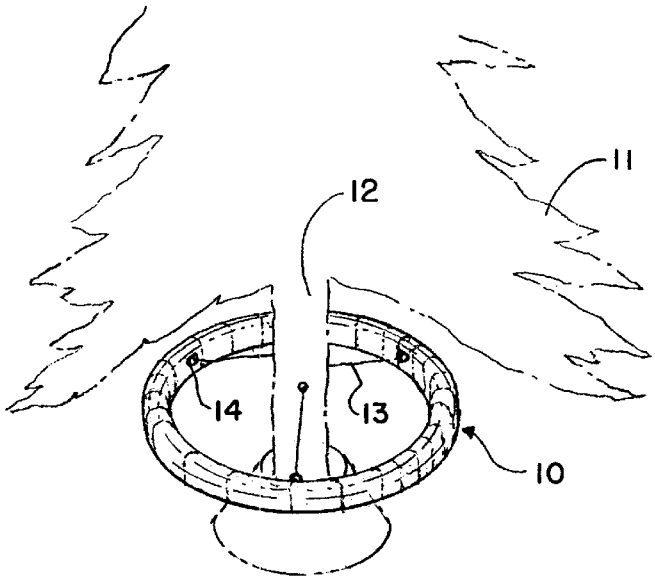
FIG. 1 is a perspective view of one embodiment of the present invention mounted to the trunk of a Christmas tree.

FIG. 1 illustrates one method by which the track assembly 10 can be attached to a Christmas tree 11. The track assembly 10 includes eyelets 14. Pieces of string 13, or any other type of cable or wire, is threaded through the eyelets 14 and then tacked or otherwise attached to the trunk of the tree 11. As a result, the track assembly 10 is suspended from the trunk 12. Alternatively, the track assembly may be placed alone on the ground or on a table around other decorations. Further, the track assembly can be designed to be lightweight enough, as in the preferred embodiment, to be mounted over the top of a tree and merely supported by the branches of a tree such as Christmas tree 11. Obviously, the ability to mount the track assembly around a Christmas tree will depend on the type of Christmas tree and the stiffness and breadth of the branches of the tree.

Figure 2:
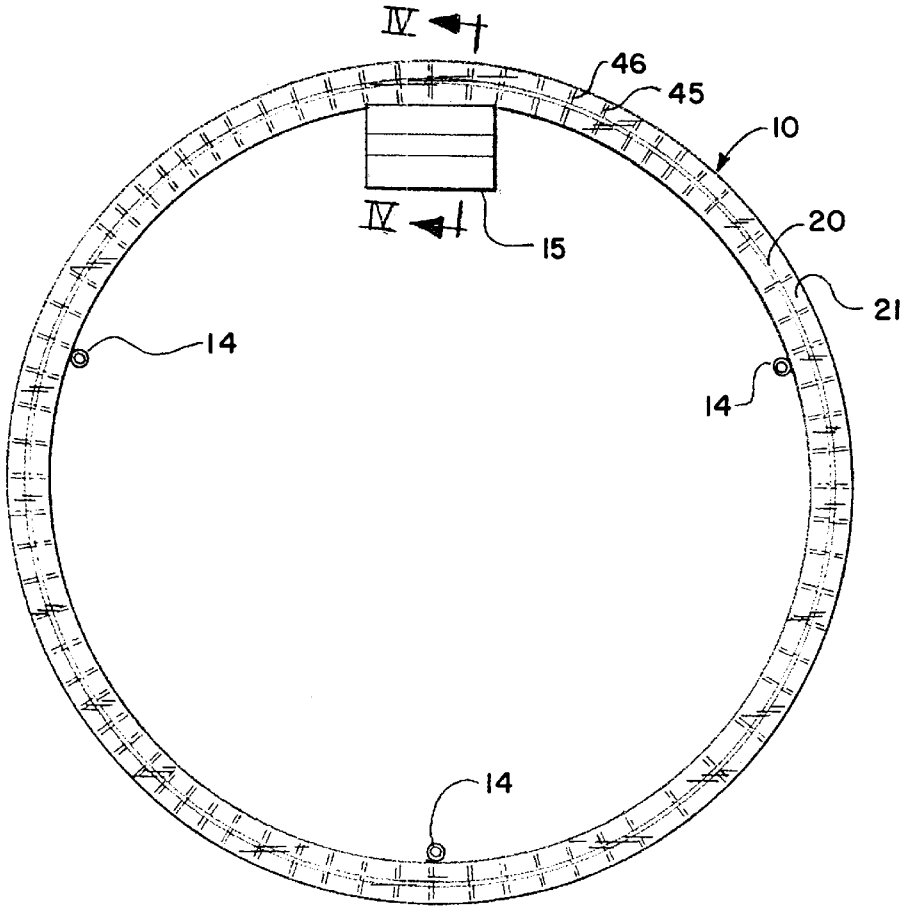
FIG. 2 is a top elevation view of one embodiment of the track assembly in accordance with the present invention.

FIG. 2 displays a top elevation view of a preferred embodiment of the track assembly 10. In this embodiment, the track assembly 10 is round in shape. The track assembly 10 may take other shapes such as ovals or generally rectangular or may even be a figure eight. The primary requirement is that the track assembly 10 be a continuous path or circuit. Also, corners of the track assembly 10 cannot be too sharp, or the ornaments traveling around the path of the track assembly 10 may have difficulty making the turns.

Turning again to FIG. 2, the track assembly 10 includes a motor housing 15. Eyelets 14 or any other type of securement means, can be used to attach or hang the track from a tree or pole. The track assembly is further made up of a flat surface 21 having a slot 20 in the concentric center of the flat surface. The flat surface 21 is the platform on which an ornament is placed and rests as it travels around the path of the track assembly 10. As illustrated, the track assembly simulates a toy train track including rails 46 and cross ties 45.

Figure 3:
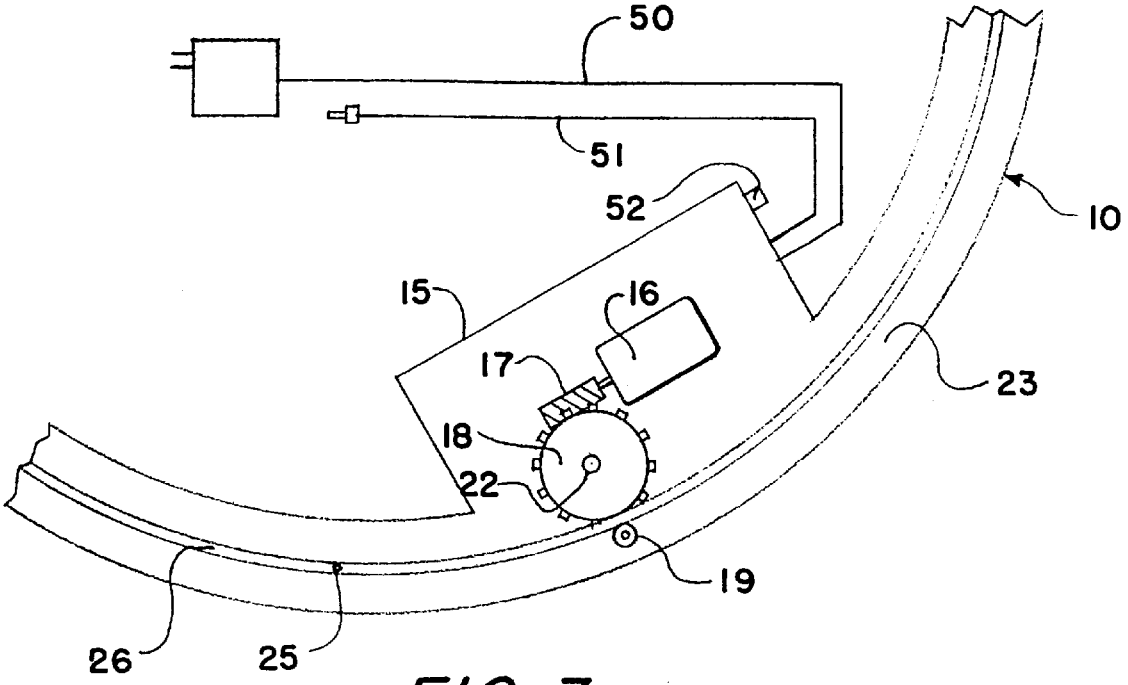
FIG. 3 is a partial, cross-sectional, top elevation view of the track assembly in accordance with the present invention.

FIG. 3 is a partial, cross-sectional view of the track assembly 10. There is shown the motor housing 15, in which is mounted the electric motor 16 which turns a worm gear 17. The turning of the worm gear 17 engages the gear wheel 18 causing it to rotate about the axis 22. Mounted adjacent to gear wheel 18 is a pinch roller 19. A cable 26 is mounted in between the gear wheel 18 and the pinch roller 19 so that when the gear wheel 18 begins rotating, the cable is forced to move by the action of the gear wheel 18 and the pinch roller 19 on the cable 26. The cable 26 is shown mounted in the base 23. There is also shown the link 25 on the cable 26. The motor housing 15 further includes an on/off switch 52. There is also shown alternative means for powering the electric motor 16. First, there is a socket plug 51 adapted to be received by a Christmas tree lightbulb socket. Alternatively, there is a conventional plug 50 that may be plugged into a wall or extension cord for powering the motor 16.

The cable 26 is a thin plastic tube which is light and flexible enough to move easily around the circuit or the path of the assembly. While this cable 26 is preferred, other elongated couplings may be utilized such as a chain comprised of linked balls, or a rigid or semirigid loop which may be toothed or untoothed.

Figure 4:
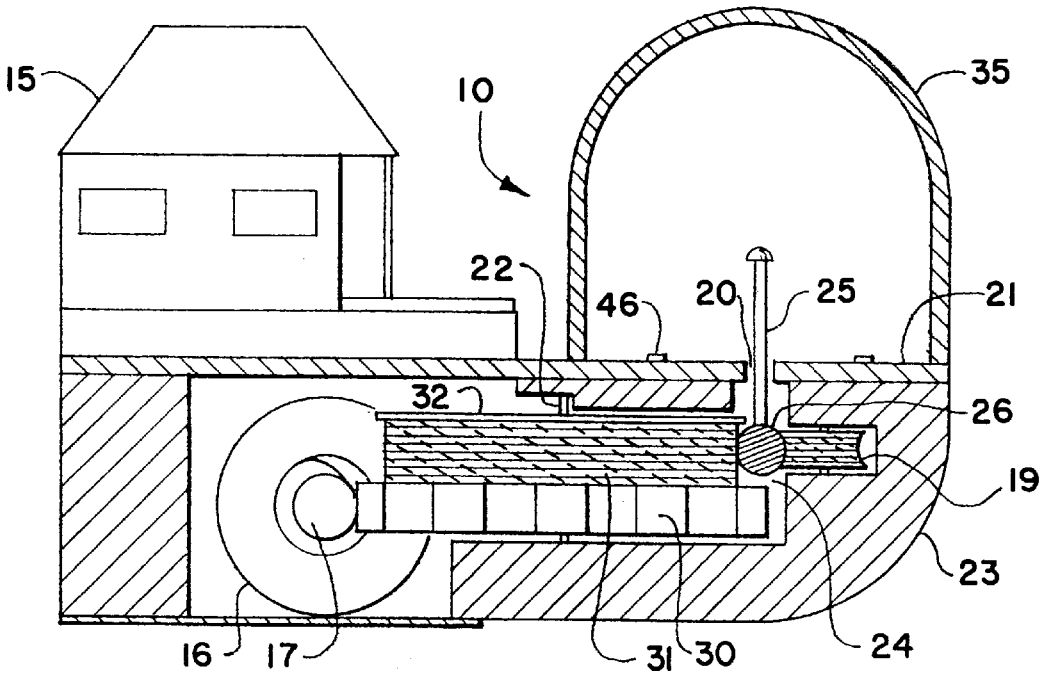
FIG. 4 is a side elevation, cross-sectional view of the track assembly in accordance with the present invention taken along line IV—IV in FIG. 2.

FIG. 4 displays a side elevation, cross-sectional view of the track assembly 10 taken along lines IV—IV in FIG. 2. The motor housing 15 simulates a toy train station. Underneath the toy train station and inside the motor housing 15 is the motor 16 and the worm gear 17. The worm gear 17 engages the gear wheel 18. The gear wheel 18 is made up of a circular gear 30, a rubber roller 31, and a washer 32. The diameter of the rubber roller 31 is less than the diameter of the washer 32 and less than the diameter of the circular gear 30. The gear wheel 18 rotates about the axis 22 that is anchored in the base 23. The base 23 is hollow in that a channel 24 extends around the path of the assembly 10. Mounted within the channel 24 is the cable 26. On the opposite side of the channel 24 from the motor housing 15 is a pinch roller 19. The cable 26 is frictionally engaged on one side by the pinch roller 19 and on the opposite side by the rubber roller 31 portion of the gear wheel 18. In order to help keep the cable 26 in between the pinch roller 19 and the rubber roller 31, the circular gear 31 and the washer 32 are of larger diameter then the rubber roller 31. Therefore, the cable 26 is restricted from vertical movement and remains frictionally engaged by the rubber roller 31 and pinch roller 19. As shown in FIG. 4, the cable 26 includes a link 25 which is a vertical pin fixed to the cable and that extends upwardly out of the channel 24 and through the slot 20. The slot 20 is defined on either side by the flat surface 21 which is the top portion of the base 23. There is also shown the decorative rails 46 on which a toy ornament, such as a toy train will ride. A plastic shield 35 is further connected to the flat surface 21 to form a tube along the path of the assembly 10. The plastic shield 35 is transparent so that the ornament, for instance a train, may be observed through the plastic shield.

Figure 5:
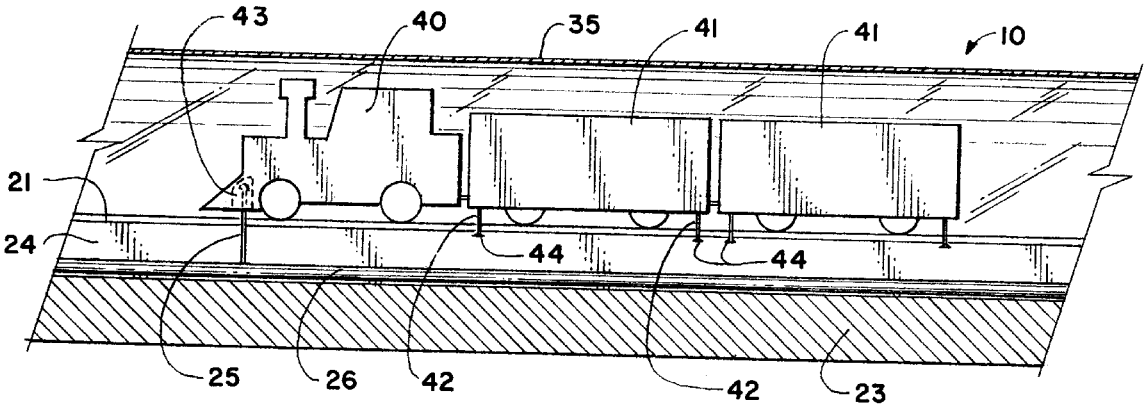
FIG. 5 is a cross-sectional, side elevation view of a portion of the track assembly in accordance with the present invention.

FIG. 5 is a partial, side elevation, cross-sectional view of the track assembly 10. The base 23 includes a channel 24. Slidably mounted within the channel is the cable 26. The cable 26 further includes a link 25 that extends upwardly out of the channel and past the level of the flat surface 21. There is shown a toy train engine 40 that is the first piece of the ornament that is guided about the track assembly 10. A recess 43 is formed in the bottom of the engine 40. The link 25 is received in the recess 43. Obviously, other types of connectors such as, for instance, hooks or magnets may be used as a connector instead of the recess 43. The toy engine 40 is attached to additional toy train cars 41. These additional ornamental pieces or toy train cars 41 are pulled around the track assembly 10 by the engine 40. Extending from the bottom of these toy train cars 41 are rivet pins 42. At the bottom of the rivet pins 42 is a rivet head 44. The diameter of the rivet head 44 is greater than the diameter of the slot 20. Therefore, the cars 41 cannot fall off of the track assembly because the rivet pin 42 and rivet head 44 keep the toy train cars 41 from vertically falling away. Finally, there is shown the plastic shield 35 which further contains the toy train.

In a preferred embodiment, the base 23 is made of a plastic material such as polyethylene or polypropylene. A base in accordance with the invention may be injection molded in a single piece, or it may be made of a plurality of pieces. It may be made of other materials such as wood or metal or of a combination of materials. The track assembly may be assembled by a purchaser or in accordance with a purchaser's specifications. It may be sold as a stock item. It is advantageous to make the track assembly of lightweight materials so that the assembly may be mounted about a tree and easily carried by the branches without additional support necessary.

In a preferred embodiment, the track assembly is one inch wide and has a circular diameter of about twenty-four inches. This means the entire assembly is easily light enough to be mounted around a tree and rested on tree branches.

Alternatives to the specific track assembly described herein include more broadly an enclosure having a closed transparent portion and a housing portion attached to the housing portion. An electric drive, for instance similar to motor 16, is disposed in the housing. An ornamental piece, for instance a toy train, is disposed for cyclical motion in the closed transparent portion. Finally, there is a coupling for coupling the electric drive to the ornamental piece so that the ornamental piece cycles within the transparent portion upon providing current to the electric drive. The closed transparent portion may be a loop or any other shape desired. The coupling would likewise be in the form of a continuous loop disposed within the transparent portion. An example of the loop and coupling is the specific track assembly described earlier. Finally, the preferred embodiment is a toy train. Other ornament pieces can be used such as, for instance, Santa's sleigh and reindeer, or the seven dwarves.

Although the invention has been described in detail for the purpose of illustration, it is to be understood and appreciated that such detail is solely and purely for the purpose of example, and that other variations, modifications and applications of the invention can be made by those skilled in the art without departing from the spirit and scope of the invention.

That which is claimed is:

1. A track toy comprising a loop track assembly, a motor, an elongated coupling, and an ornament, the track assembly comprising a hollow base having a flat surface, a slot in the flat surface, and the elongated coupling slidably mounted in a hollow channel in the base, the motor comprising a gear and a pinch roller for moving the elongated coupling in a loop path around the track assembly, the elongated coupling being a continuous member and comprising a link, and the ornament comprising a connector for receiving the link whereby the ornament is pulled around the track assembly as the elongated coupling is moved around the loop path of the track assembly.

2. The track toy described in claim 1 wherein the slot is in the middle of the flat surface.

3. The track toy described in claim 1 wherein the track assembly further comprises a transparent enclosure that, combined with the flat surface, forms a tube along the loop path.

4. The track toy described in claim 1 wherein the ornament further comprises a first piece which includes the connector and at least one more additional piece connected to the first piece whereby the additional pieces follow the first piece around the track.

5. The track toy described in claim 4 wherein the first piece is a toy train engine and the additional pieces are toy train cars.

6. The track toy described in claim 4 wherein the first piece and additional pieces further comprise rivet pins extending downwardly therefrom into the slot to center the piece as it is pulled around the track.

7. The track toy described in claim 6 wherein the rivet pins comprise heads having widths greater than the width of the slot whereby the pieces cannot fall off the track.

8. The track toy described in claim 1 wherein the track assembly further comprises securement means for attaching the track assembly to a tree.

9. The track toy described in claim 1 wherein said motor is an electric motor and is powered by a socket plug adapted to be received by a Christmas tree light bulb socket.

10. The track toy described in claim 1 wherein the elongated coupling is a cable.

11. An ornamental display comprising:

an enclosure having a closed transparent portion and a housing portion attached to the closed transparent portion;

an ornamental piece disposed for cyclical motion in the closed transparent portion;

an electric drive comprising a pinch roller disposed in the housing;

a coupling for coupling the electric drive to the ornamental piece whereby the ornamental piece cycles within the transparent portion upon providing current to the electric drive.

12. The ornamental display of claim 11 wherein the closed transparent portion is a loop, and wherein the coupling is in the form of a continuous loop disposed within the transparent portion.

13. The ornamental display of claim 12 wherein the continuous loop is a cable.

14. The ornamental display of claim 13 wherein the ornamental piece is a toy train.

15. The ornamental display of claim 12 wherein the ornamental piece is a toy train.

* * * * *